US010006597B2

(12) United States Patent
Lin

(10) Patent No.: US 10,006,597 B2
(45) Date of Patent: Jun. 26, 2018

(54) BUBBLE LAMP STRUCTURE FOR QUSAI AIR BUBBLE FLOW

(71) Applicant: Chin-San Lin, Taipei (TW)

(72) Inventor: Chin-San Lin, Taipei (TW)

( * ) Notice: Subject to any disclaimer, the term of this patent is extended or adjusted under 35 U.S.C. 154(b) by 0 days. days.

(21) Appl. No.: 15/181,426

(22) Filed: Jun. 14, 2016

(65) Prior Publication Data

US 2017/0356607 A1 Dec. 14, 2017

(51) Int. Cl.
*F21V 5/00* (2018.01)
*F21S 10/00* (2006.01)
*F21V 15/00* (2015.01)

(52) U.S. Cl.
CPC ..... *F21S 10/002* (2013.01); *F21V 15/00* (2013.01)

(58) Field of Classification Search
CPC ..... F21S 10/002; F21S 6/001; F21V 15/00; F21V 9/12; A47G 2033/0827; F21W 2121/00; Y10S 362/806; Y10S 135/91
USPC ..... 362/318, 562, 565, 569, 577
See application file for complete search history.

(56) References Cited

U.S. PATENT DOCUMENTS 4,011,444 A * 3/1977 Levy ..... A47G 33/0836 362/311.01
6,309,084 B1 * 10/2001 Lin ..... F21S 6/004 362/101
7,040,950 B1 * 5/2006 Chen ..... A63H 23/08 362/101
2003/0112621 A1 * 6/2003 Lee ..... F21S 10/002 362/96
2004/0120145 A1 * 6/2004 Damm ..... H01J 5/52 362/647

* cited by examiner

*Primary Examiner* — Elmito Breval
*Assistant Examiner* — Omar Rojas Cadima
(74) *Attorney, Agent, or Firm* — Leong C. Lei

(57) ABSTRACT

Disclosed is a bubble lamp for quasi bubble flow. A buffer made of a transparent material having an excellent heat conduction effect and impact moderating performance is configured on the top of the bulb configured on the main body of the bubble lamp or on the bottom of the glass tube configured on the upper cover, and the casing made of a transparent and no-easily-broken material is put around the glass tube, thereby abutting the glass tube against the top of the bulb across the buffer when the upper cover is covered on and coupled to the main body, allowing both the glass-made bulb and glass tube to be buffered by the butter and thus to block or decrease an impact when a contact force is too large upon assembly, and preventing the bulb or glass tube from being broken.

4 Claims, 4 Drawing Sheets

BUBBLE LAMP STRUCTURE FOR QUSAI AIR BUBBLE FLOW

(a) TECHNICAL FIELD OF THE INVENTION

The present invention relates to a lamp structure, and more particularly to a bubble lamp structure, inside which quasi air bubble flow is generated by means of high temperature.

(b) DESCRIPTION OF THE PRIOR ART

A bubble lamp for quasi bubble flow is a lamp having a bulb on which a glass tube inside which quasi bubble flow is generated by means of high temperature is configured. The bubble lamp for quasi bubble flow, as FIG. 1 shows, mainly includes a main body 10, upper cover 20, bulb 30 and glass tube 40 inside which fluid 41 with a low boiling point and several fine color particles 42. An opening is configured on the top of the main body 10, and a smaller circular hole the bottom thereof; the bulb 30 is placed on the main body 10, and a screw base 31 on the bottom of the bulb 30 is passed through the circular hole to expose out of the main body 10; an opening is configured on the bottom of the upper cover 20, and a smaller circular hole the top thereof; the glass tube 40 is inserted in the upper cover 20 through the circular hole, and the upper half of the glass tube 40 is exposed out of the top of the upper cover 20. Upon assembly, the upper cover 20 is covered on and fixed to the main body 10, while the top of the bulb 30 is allowed to be contacted with and abutted against the bottom of the glass tube 40. As arranged, the bulb 30 will generate high temperature heat energy after it is lighted; the heat energy can be not only radiated by air conduction but transmitted quickly to the glass tube 40 through the contact in such a way to allow the fluid 41 with a low boiling point to flow vertically inside the glass tube 40 due to the heat energy, and thus drive the fine color particles 42 also to flow vertically with it so as to form a quasi bubble flow pattern, thereby allowing the bubble lamp to have not only dazzle bright lighting but the contrast of quasi color bubble flow to promote the visual effect of the bubble lamp.

But, the bubble lamp structure mentioned above has the defects: the glass-made glass tube and bulb must be abutted against each other after assembly, and the best heat conduction effect can then be achieved. However, if the contact force between the glass tube and bulb is too large upon assembly, one of them is easy to be broken. Furthermore, the glass tube and bulb are expanded due to temperature change upon the direct contact and abutment thereof to cause them to push each other, probably resulting in the rupture thereof. Therefore, conventional bubble lamp structures are not ideal, necessary to be improved.

SUMMARY OF THE INVENTION

The main object of the present invention is to provide a bubble lamp structure for quasi bubble flow, preventing a glass tube or bulb from being damaged easily upon the assembly or use of the bubble lamp.

To achieve the object mentioned above, the solution is that a buffer made of a transparent material having an excellent heat conduction effect and impact moderating performance is configured on the top of the bulb configured on the main body of the bubble lamp or on the bottom of the glass tube configured on the upper cover, and the casing made of a transparent and no-easily-broken material is put around the glass tube, thereby abutting the glass tube against the top of the bulb across the buffer when the upper cover is covered on and coupled to the main body, allowing both the glass-made bulb and glass tube to be buffered by the butter and thus to block or decrease an impact when a contact force is too large upon assembly, and preventing the bulb or glass tube from being broken. Furthermore, the heat generated from the bulb can be conducted effectively to the glass tube. In addition, the glass tube can be prevented from being broken due to collision, or the fragments of the glass tube can be maintained in the casing without scattering around to cut people close to the bubble lamp when the glass tube is subject to a larger external force and is thus compressed or struck to break because the casing is put around the glass tube.

DETAILED DESCRIPTION OF THE PREFERRED EMBODIMENTS

Figure 1:
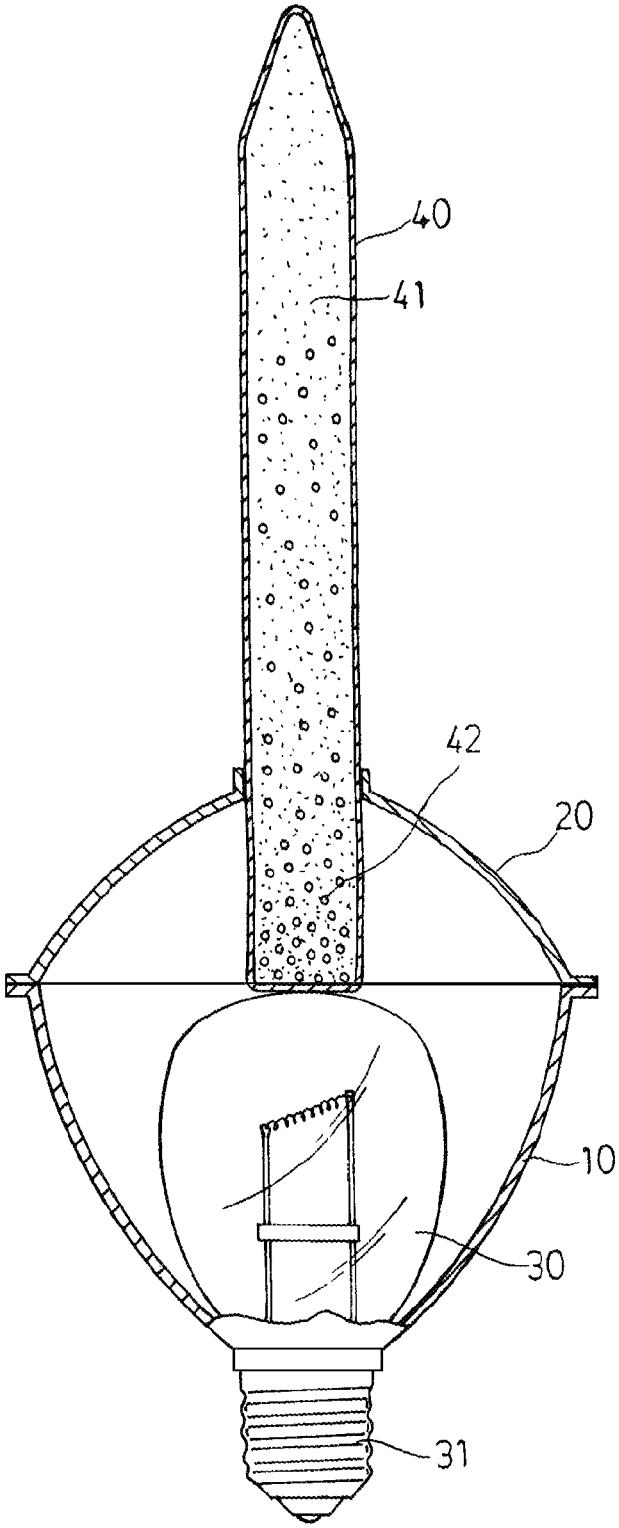
FIG. 1 PRIOR ART
FIG. 1 is a cross-sectional view of a conventional bubble lamp.
Figure 2:
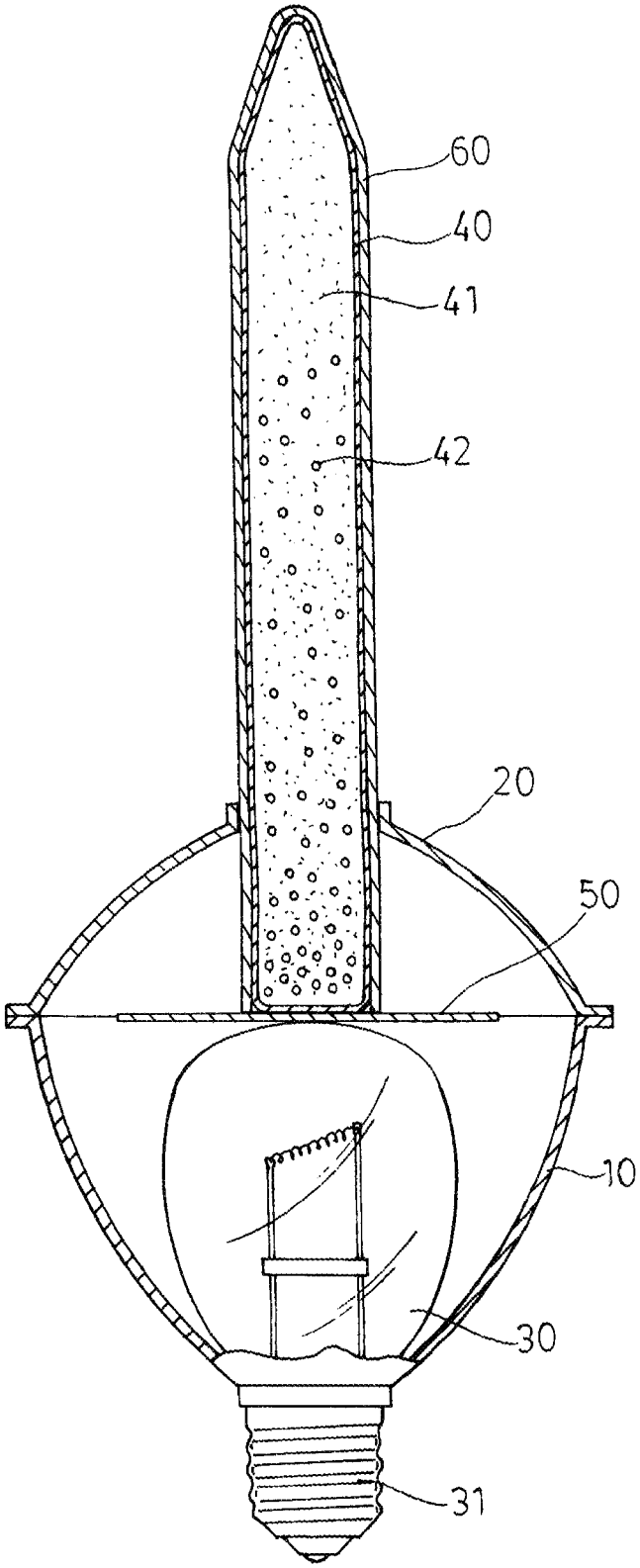
FIG. 2 is a cross-sectional view of a bubble lamp according to the present invention.

Referring to FIG. 2, a bubble lamp for quasi bubble flow of the present invention mainly includes a main body 10, upper cover 20, bulb 30, glass tube 40, buffer 50 and casing 60. An opening is configured on the top of the main body 10, and a smaller circular hole on the bottom thereof; the bulb 30 is placed on the main body 10, and a screw base 31 on the bottom of the bulb 30 is passed through the circular hole to expose out of the main body 10; an opening is configured on the bottom of the upper cover 20, and a smaller circular hole on the top thereof; fluid 41 with a low boiling point and several fine color particles 42 are filled in the glass tube 40; the glass tube 40 is inserted in the upper cover 20 through the circular hole, and the upper half of the glass tube 40 is exposed out of the top of the upper cover 20 the present invention is characterized in that the buffer 50 made of a transparent material having an excellent heat conduction effect and impact moderating performance is configured on the top of the bulb 30 configured on the main body 10 of the bubble lamp or on the bottom of the glass tube 40 configured on the upper cover 20, and the casing 60 made of a transparent and no-easily-broken material is put around the glass tube 40, thereby abutting the glass tube 40 against the top of the bulb 30 across the buffer 50 when the upper cover 20 is covered on and coupled to the main body 10, allowing the both glass-made bulb 30 and glass tube 40 to be buffered by the butter 50 and thus to block or decrease an impact when a contact force is too large upon assembly, and preventing the bulb 30 or glass tube 40 from being broken. Furthermore, the bulb 30 or glass tube 40 are not broken even if the temperature is high enough to cause them to be expanded to push each other because they are not in direct contact, and at the same time, the heat generated from the bulb can be conducted effectively to the glass tube 40 to arouse the fluid 41 with a low boiling point inside the glass tube 40 to flow vertically inside the glass tube 40 together with the fine color particles 42 due to high temperature, thereby forming a quasi bubble flow pattern.

The buffer 50 mentioned above may be a sheet-, casing-, spring-shaped structural body or structural body with other shape, and attached to the bulb 30 and/or glass tube 40 by gluing one side or two sides thereof with an adhesive such as EVZ glue or foaming glue.

Figure 3:
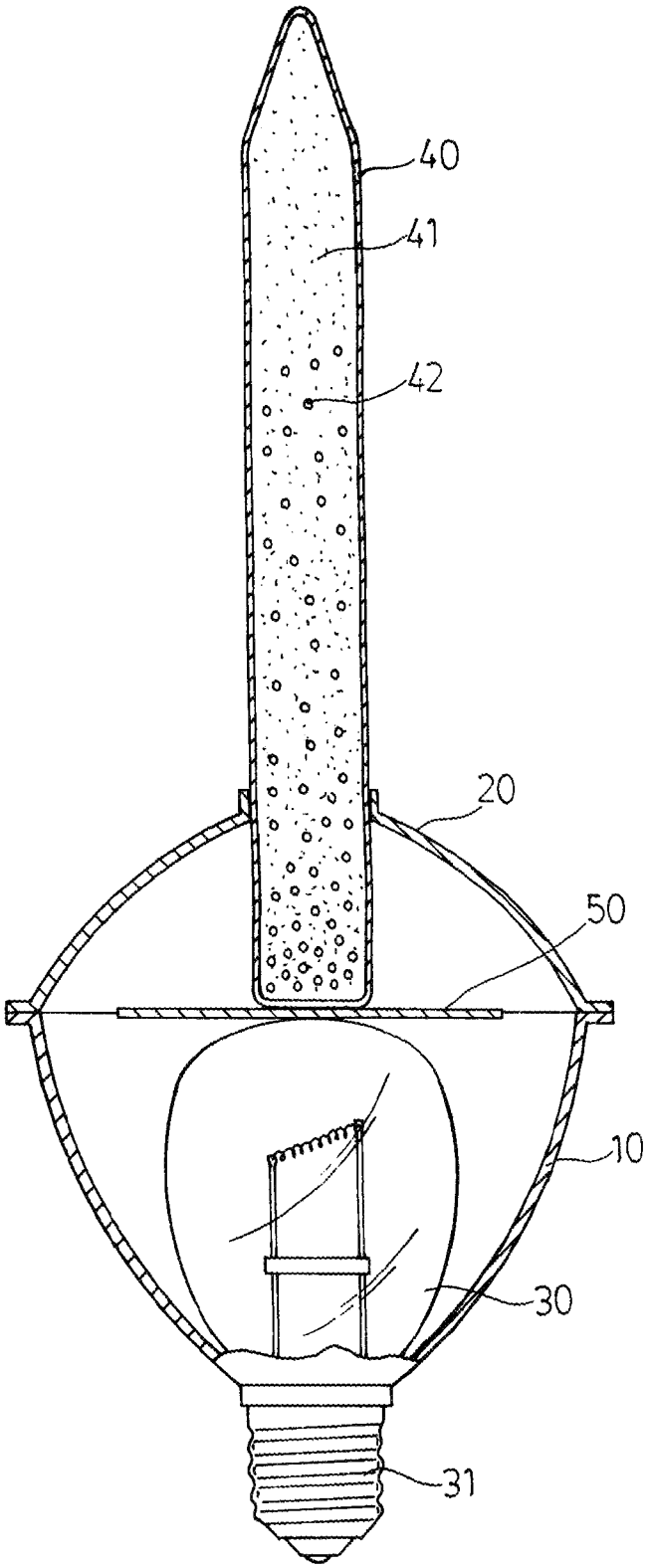
FIGS. 3 and 4 respectively are a cross-sectional view of a variant embodiment of a bubble lamp structure according to the present invention.

Referring to FIG. 3, a bubble lamp for quasi bubble flow of the present invention mainly includes a main body 10, upper cover 20, bulb 30, glass tube 40 and buffer 50. An opening is configured on the top of the main body 10, and a smaller circular hole on the bottom thereof, the bulb 30 is placed on the main body 10, and a screw base 31 on the bottom of the bulb 30 is passed through the circular hole to expose out of the main body 10; an opening is configured on the bottom of the upper cover 20, and a smaller circular hole on the top thereof; fluid 41 with a low boiling point and several fine color particles 42 are filled in the glass tube 40; the glass tube 40 is inserted in the upper cover 20 through the circular hole, and the upper half of the glass tube 40 is exposed out of the top of the upper cover 20. The present invention is characterized in that the buffer 50 made of a transparent material having an excellent heat conduction effect and impact moderating performance is configured on the top of the bulb 30 configured on the main body 10 of the bubble lamp or on the bottom of the glass tube 40 configured on the upper cover 20.

Figure 4:
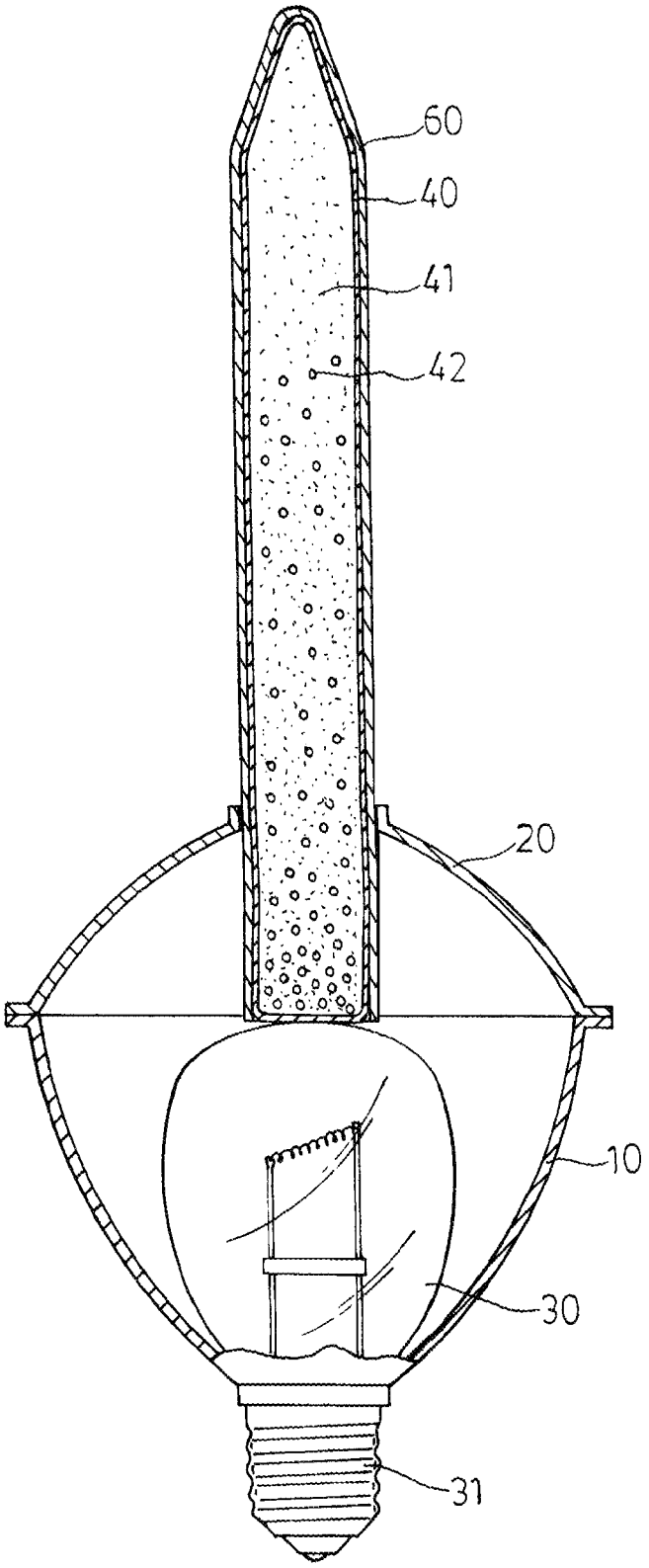

Referring to FIG. 4, a bubble lamp for quasi bubble flow of the present invention mainly includes a main body 10, upper cover 20, bulb 30, glass tube 40 and casing 60. An opening is configured on the top of the main body 10, and a smaller circular hole on the bottom thereof; the bulb 30 is placed on the main body 10, and a screw base 31 on the bottom of the bulb 30 is passed through the circular hole to expose out of the main body 10; an opening is configured on the bottom of the upper cover 20, and a smaller circular hole on the top thereof; fluid 41 with a low boiling point and several fine color particles 42 are filled in the glass tube 40; the glass tube 40 is inserted in the upper cover 20 through the circular hole, and the upper half of the glass tube 40 is exposed out of the top of the upper cover 20. The present invention is characterized in that the casing 60 made of a transparent and no-easily-broken material is put around the glass tube 40.

I claim:

1. A bubble lamp for quasi bubble flow, comprising a main body, upper cover, bulb, glass tube, buffer and casing; an opening being configured on a top of said main body, and a smaller circular hole on a bottom thereof; said bulb is placed on said main body, and a screw base on a bottom of said bulb being passed through said smaller circular hole to be exposed out of said main body; another opening being configured on a bottom of said upper cover, and another smaller circular hole on a top thereof; fluid with a low boiling point and several fine color particles being filled in said glass tube; said glass tube being inserted in said upper cover through said another smaller circular hole, and an upper half of said glass tube being exposed out of said top of said upper cover; wherein said buffer made of a transparent material having an excellent heat conduction effect and impact moderating performance is configured on a top of said bulb configured on said main body of said bubble lamp or on a bottom of said glass tube configured on said upper cover, and said casing made of a transparent and no-easily-broken material is put around said glass tube; wherein said buffer is interposed between and in direct contact with said bulb and said glass tube to provide impact protection between said bulb and said glass tube; and wherein said casing is provided over and in direct contact with an outside surface of said glass tube.

2. The structure according to claim 1, wherein said buffer is a sheet-shaped, casing-shaped or spring-shaped structural body, and attached to one of said bulb and said glass tube or both of said bulb and said glass tube by coating one side or two sides thereof with foaming glue.

3. A bubble lamp for quasi bubble flow, comprising a main body, upper cover, bulb, glass tube, buffer and casing; an opening being configured on a top of said main body, and a smaller circular hole on a bottom thereof; said bulb is placed on said main body, and a screw base on a bottom of said bulb being passed through said smaller circular hole to be exposed out of said main body; another opening being configured on a bottom of said upper cover, and another smaller circular hole on a top thereof; fluid with a low boiling point and several fine color particles being filled in said glass tube; said glass tube being inserted in said upper cover through said another smaller circular hole, and an upper half of said glass tube being exposed out of said top of said upper cover; wherein said buffer made of a transparent material having an excellent heat conduction effect and impact moderating performance is configured on a top of said bulb configured on said main body of said bubble lamp or on a bottom of said glass tube configured on said upper cover; wherein said buffer is interposed between and in direct contact with said bulb and said glass tube to provide impact protection between said bulb and said glass tube.

4. The structure according to claim 3, wherein said buffer is a sheet-shaped, casing-shaped or spring-shaped structural body, and attached to one of said bulb and said glass tube or both of said bulb and said glass tube by coating one side or two sides thereof with foaming glue.

* * * * *